US009315733B2

(12) United States Patent
Koseoglu et al.

(10) Patent No.: US 9,315,733 B2
(45) Date of Patent: Apr. 19, 2016

(54) ASPHALT PRODUCTION FROM SOLVENT DEASPHALTING BOTTOMS

(75) Inventors: Omer Refa Koseoglu, Dhahran (SA); Salman Al-Khaldi, Dammam (SA); Adnan Al-Hajji, Dammam (SA); Ali Al-Hamadh, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 782 days.

(21) Appl. No.: 12/497,249

(22) Filed: Jul. 2, 2009

(65) Prior Publication Data

US 2009/0301931 A1 Dec. 10, 2009

Related U.S. Application Data

(63) Continuation-in-part of application No. 11/584,771, filed on Oct. 20, 2006, now Pat. No. 7,566,394.

(51) Int. Cl.
*C10C 3/08* (2006.01)
*C10C 3/00* (2006.01)
*C10G 21/00* (2006.01)

(52) U.S. Cl.
CPC ... *C10C 3/08* (2013.01); *C10C 3/00* (2013.01); *C10G 21/003* (2013.01)

(58) Field of Classification Search
CPC ..... C10C 3/08
See application file for complete search history.

(56) References Cited

U.S. PATENT DOCUMENTS

| | | | | |
|---|---|---|---|---|
| 2,139,161 | A | 12/1938 | Hutchins et al. | |
| 2,453,933 | A | 11/1948 | Polizzotto et al. | |
| 2,729,589 | A * | 1/1956 | Waghorne et al. | 208/309 |
| 2,847,353 | A * | 8/1958 | Beavon | 208/309 |
| 3,227,645 | A | 1/1966 | Frumkin et al. | |
| 3,252,894 | A | 5/1966 | Gatsis et al. | |
| 3,775,292 | A | 11/1973 | Watkins | |
| 3,968,023 | A | 7/1976 | Yan | |
| 4,017,383 | A | 4/1977 | Beavon | |
| 4,101,415 | A | 7/1978 | Crowley | |
| 4,125,458 | A | 11/1978 | Bushnell et al. | |
| 4,239,616 | A | 12/1980 | Gearhart | |
| 4,290,880 | A | 9/1981 | Leonard | |
| 4,299,687 | A | 11/1981 | Myers et al. | |
| 4,305,814 | A | 12/1981 | Leonard | |
| 4,332,673 | A | 6/1982 | Myers | |
| 4,411,790 | A | 10/1983 | Arod et al. | |
| 4,427,539 | A | 1/1984 | Busch et al. | |
| 4,482,453 | A | 11/1984 | Coombs et al. | |
| 4,502,944 | A | 3/1985 | Nelson | |
| 4,572,781 | A | 2/1986 | Krasuk et al. | |
| 4,663,028 | A | 5/1987 | Ditman | |
| 4,686,028 | A | 8/1987 | Van Driesen et al. | |
| 4,747,936 | A | 5/1988 | Penning | |
| 4,747,937 | A | 5/1988 | Hilfman et al. | |
| 4,810,367 | A | 3/1989 | Chombart et al. | |
| 4,816,140 | A | 3/1989 | Trambouze et al. | |
| 4,885,080 | A | 12/1989 | Brown et al. | |
| 4,980,045 | A | 12/1990 | Krishna et al. | |
| 5,374,350 | A | 12/1994 | Heck et al. | |
| 5,454,933 | A | 10/1995 | Savage et al. | |
| 5,728,291 | A | 3/1998 | Miller et al. | |
| 6,245,223 | B1 | 6/2001 | Gorbaty et al. | |
| 6,274,030 | B1 | 8/2001 | Wallace et al. | |
| 6,468,417 | B1 | 10/2002 | Biscardi et al. | |
| 6,558,531 | B2 | 5/2003 | Steffens et al. | |
| 6,783,662 | B2 | 8/2004 | Draemel et al. | |
| 6,805,790 | B2 | 10/2004 | Gupta et al. | |
| 7,025,822 | B2 | 4/2006 | Partanen et al. | |
| 2002/0035306 | A1 | 3/2002 | Gore et al. | |
| 2005/0040078 | A1 | 2/2005 | Zinnen et al. | |
| 2005/0092655 | A1 | 5/2005 | Nicolaos et al. | |
| 2005/0173297 | A1 | 8/2005 | Toida | |
| 2006/0131217 | A1 | 6/2006 | Nicolaos et al. | |
| 2006/0175229 | A1 | 8/2006 | Montanari et al. | |
| 2006/0213808 | A1 | 9/2006 | Barthelet et al. | |
| 2006/0213809 | A1 | 9/2006 | Barthelet et al. | |
| 2007/0108100 | A1 | 5/2007 | Satchell, Jr. | |
| 2007/0267327 | A1 | 11/2007 | Boakye | |
| 2008/0093260 | A1 * | 4/2008 | Koseoglu | 208/96 |
| 2008/0271639 | A1 * | 11/2008 | Partanen et al. | 106/273.1 |
| 2008/0318763 | A1 * | 12/2008 | Anderson | 502/33 |

FOREIGN PATENT DOCUMENTS

WO 2008057587 A2 5/2008

OTHER PUBLICATIONS

A. K. Karashov et al., Spent Clay as an Additive for Roofing and Waterproofing Materials, 32 Chem. Technol. Fuels Oils 257-260 (1996).*

PCT/US2010/039599, International Search Report and Written Opinion dated Aug. 23, 2010, 7 pages.

PCT/US2010/039599, International Preliminary Report on Patentability dated Dec. 12, 2011, 23 pages.

Kartashov, A.K. et al., "Spent Clay as an Additive for Roofing and Waterproofing Materials," Chemistry and Technology of Fuels and Oils, vol. 32, No. 5, 1996 (pp. 257-260).

* cited by examiner

*Primary Examiner* — Randy Boyer
(74) *Attorney, Agent, or Firm* — Abelman, Frayne & Schwab

(57) ABSTRACT

A cost-effective solution is provided for eliminating refinery process waste, including spent catalytic and non-catalytic adsorbent materials, as well as adsorbate process reject materials derived from desorption, while minimizing conventional waste handling demands. An asphalt composition includes asphalt and spent adsorbent material from a solvent deasphalting unit. The asphalt can comprise asphaltic material obtained from a solvent deasphalting unit, and spent adsorbent material in the asphalt composition was previously utilized in the solvent deasphalting unit. The asphalt composition can also include process reject materials.

5 Claims, 2 Drawing Sheets

ASPHALT PRODUCTION FROM SOLVENT DEASPHALTING BOTTOMS

RELATED APPLICATIONS

The present application is a Continuation-in-Part of U.S. application Ser. No. 11/584,771 filed Oct. 20, 2006, now U.S. Pat. No. 7,566,394 the disclosure of which is incorporated herein by reference.

BACKGROUND OF THE INVENTION

1. Field of the Invention

This invention relates to asphalt compositions and processes for the economical and environmentally sound disposal of solvent deasphalting bottoms.

2. Description of Related Art

Asphalt, also referred to as mineral pitch, is obtained from natural deposits such as native asphalt, or derived as a product from crude oil or other hydrocarbon refinery processes, known as petroleum asphalt. Asphalt is generally a mixture of hydrocarbons known as bitumen and typically takes the form of a sticky, black and highly viscous liquid or semi-solid. Modern petroleum asphalt has the same durable qualities as naturally occurring asphalt, with the added advantage of being refined to a typically uniform condition free from organic and mineral impurities.

Asphalt is a strong, versatile, and weather and chemical-resistant binding material that adapts itself to a variety of uses. Asphalt binds aggregate such as crushed stone and gravel into a mixture commonly known as asphaltic concrete, which is formed into firm, tough surfaces for roadways and airport runways, as is very well known. A majority of petroleum asphalt produced today is used for the surfacing of roadways and runways. Asphalt paving material is a dull black mixture of asphalt and aggregate, including sand and crushed stone. Asphalt paving material is typically transported and dumped while hot onto a road surface, leveled, and compacted. Hot liquid asphalt is also used alone for expansion joints and patches on concrete roads. Airport runways, tennis courts, playgrounds, and floors of certain buildings also employ asphalt. Light forms of petroleum asphalt known as road oils are sprayed on roadways to settle dust and bind gravel.

Another major use of asphalt is in asphalt shingles and roofing paper or felt. The asphalt helps to preserve and waterproof the roofing material. Other applications for asphalt include waterproofing tunnels, bridges, dams and reservoirs; rust-proofing and sound-proofing metal pipes and automotive under-bodies; and soundproofing walls and ceilings.

In a typical refining process, crude oil is initially heated followed by separation into its various fractions through distillation. The lighter and more volatile components, or fractions, are vaporized and drawn off through a series of distillation levels. The fractions are then generally refined into naphtha or gasoline (considered a "light" distillate), kerosene or jet fuel (considered a "medium" distillate), gas oil or diesel oil (considered a "heavy" distillate), and other useful petroleum products. The heavy residue from this atmospheric distillation process is commonly referred to as topped crude, residual oil or atmospheric residue. This topped crude can be used for fuel oil, or further processed into other products including asphalt. Since asphalt is a heavy constituent of crude petroleum, it does not evaporate or boil off during the distillation process and remains as bottoms. Petroleum asphalt can also be produced from other intermediate refining process units such as hydroprocessing, visbreaking, coking, and solvent deasphalting.

Residual oil can be processed in certain applications by vacuum distillation to remove enough boiling fractions to produce "straight run" asphalt. However, if the topped crude contains enough low volatility, high-boiling components which cannot be economically removed through distillation, solvent extraction, also known as solvent deasphalting, may be required to produce asphalt of the desired consistency.

Solvent deasphalting is a process employed in oil refineries to extract valuable components from residual oil. The extracted components can be further processed in refineries where they are cracked and converted into valuable lighter fractions, such as gasoline and diesel. Suitable residual oil feedstocks which can be used in solvent deasphalting processes include, for example, atmospheric tower bottoms, vacuum tower bottoms, crude oil, topped crude oils, coal oil extract, shale oils, and oils recovered from tar sands. Solvent deasphalting processes are well known and described, for instance, in Yan U.S. Pat. No. 3,968,023, Beavon U.S. Pat. No. 4,017,383, and Bushnell et al. U.S. Pat. No. 4,125,458, all of which disclosures are incorporated herein by reference.

In a typical solvent deasphalting process, a light hydrocarbon solvent, usually one or more paraffinic compounds, is admixed with a residual oil feed and is processed to separate the flocculated solid from the oil mixture. Common solvents and their mixtures used in deasphalting include normal and/or iso paraffins with carbon numbers ranging from 1-7, preferably from 3-7, including methane, ethane, propane, butane, iso-butane, pentane, iso-pentane, neo-pentane, hexane, and iso-hexane. Under elevated temperatures and pressures, generally below the critical temperature, in an asphaltene separator, the mixture is separated into two liquid streams, including (1) a substantially asphaltenes-free stream of deasphalted oil, including resins, and (2) a mixture of asphaltenes and solvent including some dissolved deasphalted oil.

The substantially asphaltenes-free mixture of deasphalted oil and solvent is normally passed to a solvent recovery system. The solvent recovery system of an solvent deasphalting unit extracts a fraction of the solvent from the solvent-rich deasphalted oil by boiling off the solvent, commonly using steam or hot oil from heaters. The solvent is recycled and sent back for use in the solvent deasphalting unit.

In some processes the deasphalted oil fraction is also separated in to a resins fraction and a resins-free fraction. "Resins" as used herein means materials that have been separated and obtained from a solvent deasphalting unit. Resins are denser and heavier than deasphalted oil, e.g., maltenes, but lighter than asphaltenes. The resin product usually comprises aromatic hydrocarbons with highly aliphatic-substituted side chains, and can also include metals, such as nickel and vanadium. Generally, the resins are composed of material remaining after removal of asphaltenes and deasphalted oil.

Watkins U.S. Pat. No. 3,775,292 teaches a solvent deasphalting process where feedstock is deasphalted using a solvent, and then the resin is removed using a selective solvent in a solvent extraction unit so as to provide solvent-lean resin concentrate and a de-resined second liquid phase. Neither solvent is recovered, and the resin and the deasphalted oil is further processed in a hydrocracking unit so as to produce lower boiling hydrocarbons.

Crowley U.S. Pat. No. 4,101,415 and Ven Driesen et al. U.S. Pat. No. 4,686,028 teach similar solvent deasphalting processes in which a feedstock is subjected to a solvent extraction step that removes both the asphaltenes and the resin, resulting in an asphaltene-free and resin-free deasphalted oil. The asphaltene/resin mixture removed from the feedstock is then subjected to a second solvent extraction step that separates the resins from the asphaltenes.

Asphalt can also be blended or "cut back" with a volatile substance, resulting in a product that is soft and workable at a lower temperature than pure asphalt. When the cut-back asphalt is used for paving or construction, the volatile cutter solvent evaporates when exposed to air or heat, leaving hardened asphalt behind. The volatility of the cutting solvent classifies the cutback asphalt as slow, medium, or rapid-curing asphalt. For example, heated asphalt that is mixed with residual asphaltic oil from the earlier distillation process is described as slow-curing asphalt. Asphalt including blends of gasoline or naphtha is described as medium-curing asphalt, and blends of kerosene is described as rapid-curing asphalt.

In addition, asphalt can be emulsified in water to produce a liquid that can be easily pumped through pipes, mixed with aggregate, or sprayed through nozzles. The asphalt is ground into globules of about 5 to 10 microns or less, and mixed with water and an emulsifying agent. The emulsifying agent reduces the tendency of the asphalt and water to separate, and can be colloidal clay, soluble or insoluble silicates, soap, or other oils.

Asphalt can also be pulverized to produce a powdered material. The asphalt is crushed and passed through a series of fine mesh sieves to obtain uniform size granules. Powered asphalt can be mixed with road oil and aggregate for pavement construction. The heat and pressure in the road slowly amalgamates the powder with the aggregate and binding oil, and the substance hardens to a consistency similar to regular asphaltic concrete.

If asphalt is to be used for a purpose other than paving, such as roofing, pipe coating, or as an automotive under-coating sealant or water-proofing material, it may be oxidized, typically referred to as "air blown" asphalt. This process produces a material that softens at a higher temperature than paving asphalts. The material can be air blown at the refinery, at an asphalt processing plant, or at a roofing material plant. The asphalt is heated to about 260° C., and air is bubbled through the asphalt for 1 to 4.5 hours. When cooled to ambient temperatures, the asphalt remains in a liquid phase.

Two main types of asphaltic concrete compositions include hot-mix and cold-mix. Cold-mix asphalt generally incorporates emulsified or cut-back asphalts, and is usually used for light to medium traffic secondary roads, in remote locations or for maintenance use.

Hot-mix asphalt is commonly used for heavier traffic, and is a mixture of suitable aggregate coated with asphalt. The term "hot-mix" is derived from the process of heating the aggregate and asphalt before mixing to remove moisture from the aggregate and to obtain sufficient fluidity of the asphalt for proper mixing and work-ability. Asphalt and aggregate are combined in a mixing facility where they are heated, proportioned, and mixed to produce the desired paving mixture. Hot-mix facilities may be permanently located (also called "stationary" facilities), or it may be portable and situated on site, and can be classified as either a batch facility or a drum-mix facility. Batch-type hot-mixing facilities use different size fractions of hot aggregate which are drawn in proportional amounts from storage bins to make up a single batch for mixing. The combination of aggregates is dumped into a mixing vessel. A proportional amount of asphalt is thoroughly mixed with the aggregate in the mixing vessel. After mixing, the material is then emptied into trucks, storage silos, or surge bins. The drum-mixing process heats and blends the aggregate with asphalt all at the same time in the drum mixer. When the mixing is complete, the hot-mix is then transported to the paving site and spread in a partially compacted layer to a uniform, even surface with a paving machine. While still hot, the paving mixture is further compacted by heavy rolling machines to produce a smooth pavement surface.

The quality of asphalt is affected by the inherent properties of the petroleum crude oil from which it was produced. Different oil fields and geographic regions produce crude oils with very different characteristics. The refining method also impacts the asphalt quality. For engineering and construction purposes, important factors include: consistency, also referred to as the viscosity or the degree of fluidity of asphalt at a particular temperature; purity; and worker safety.

The consistency or viscosity of asphalt varies with temperature, and asphalt is graded based on ranges of consistency at a standard temperature. Careless temperature and mixing control can cause more hardening damage to asphalt than many years of service on a roadway. A standardized viscosity or penetration test is commonly specified to measure paving asphalt consistency. Air-blown asphalts typically use a softening point test.

Purity of asphalt can be easily tested since it is composed almost entirely of bitumen, which is soluble in carbon disulfide. Refined asphalts are usually more than 99.5% soluble in carbon disulfide and any impurities that remain are inert. Because of the hazardous flammable nature of carbon disulfide, trichloroethylene (TCE), which is also an excellent solvent for asphalt, is used in the solubility purity tests.

Asphalt must be free of water or moisture as it leaves the refinery. However, transports loading the asphalt may have moisture present in their tanks or beds. This can cause the asphalt to foam when it is heated above 100° C., which poses a safety hazard. Specifications usually require that asphalts resist foaming at temperatures up to 175° C. If heated to a sufficiently high temperature, asphalt will release fumes which can flash in the presence of a spark or open flame. The temperature at which this occurs, the flashpoint, is well above temperatures normally used in paving operations. Because of the possibility of asphalt foaming and to ensure an adequate margin of safety, the flashpoint of the asphalt is measured and controlled.

Another important engineering property of asphalt is its ductility, which is a measure of a material's ability to be pulled, drawn, or deformed. The presence or absence of ductility is usually more important than the actual degree of ductility because some asphalt compositions having a high degree of ductility are also more temperature sensitive. Ductility is measured by an "extension" test, whereby a standard asphalt briquette molded under prescribed conditions and dimensions is pulled at a specified temperature (normally 25° C.) until it breaks under tension. The elongation at which the asphalt sample breaks is a measure of the ductility of the sample.

Related U.S. application Ser. No. 11/584,771, incorporated by reference herein, describes an enhanced solvent deasphalting process where a hydrocarbon oil feedstock containing asphaltenes is introduced into a mixing vessel with a paraffinic solvent and a solid adsorbent material. The solid adsorbent material can include attapulgus clay, alumina, silica activated carbon and zeolite catalyst materials, and combinations of those adsorbent materials. The solid asphaltenes formed in the paraffinic solvent phase are mixed with the adsorbent material for a time sufficient to adsorb sulfur- and nitrogen-containing polynuclear aromatic molecules on the adsorbent material. The solid phase comprising asphaltenes and adsorbent is separated from the oil/solvent mixture. The oil/solvent mixture is passed to a separation vessel to separate the deasphalted oil and paraffinic solvent, and recovere the solvent for recycling to the mixing vessel. The asphalt/adsorbent material mixture is passed to a filtration vessel with an aromatic or polar solvent to desorb the adsorbed compounds and to recover the solid asphalt phase. The aromatic or polar solvent mixture is then passed to a fractionator to recover the solvent. This process provides deasphalted oil with greater than 50 weight % reduction in sulfur and greater than 75 weight % reduction in nitrogen, compared to conventional solvent deasphalting processes that reduce only about 20 weight % of sulfur and 37 weight % of nitrogen.

During the various processes in a refinery, certain materials, typically those used as catalytic and non-catalytic adsorbent materials, must be reconditioned and/or removed after they are considered "spent," i.e., their adsorbent capacity and/or catalytic activity falls below a desired efficacy. Adsorbent materials such as attapulgus clay, alumina, silica, activated carbon, silica alumina or zeolite catalyst material are used in the enhanced solvent deasphalting process described in U.S. application Ser. No. 11/584,771, and other intermediate refining processes including but not limited to hydrotreating, hydrocracking, and fluid catalytic cracking. The adsorbent includes constituents such as heavy polynuclear aromatic molecules, sulfur, nitrogen and/or metals. Disposal of these adsorbent as waste materials incurs substantial expense and entails environmental considerations.

In addition, when adsorbent materials are reconditioned, for example, by solvent desorption, heat desorption or pyrolysis at high temperatures, the process reject removed from the adsorbent materials must also be disposed of. These adsorbent materials can include heavy hydrocarbon molecules containing sulfur, nitrogen and/or heavy aromatic molecules, and metals such as nickel and vanadium.

Therefore, a need exists for a cost-effective solution for eliminating refinery process waste, including spent catalytic and non-catalytic adsorbent materials, as well as adsorbate process reject materials derived from desorption, while minimizing conventional waste handling demands.

SUMMARY OF THE INVENTION

The present invention provides a cost-effective solution for eliminating refinery process waste, including spent catalytic and non-catalytic adsorbent materials, as well as adsorbate process reject materials derived from desorption, while minimizing conventional waste handling demands.

According to the present invention, an asphalt composition is provided comprising asphalt and spent adsorbent material from a solvent deasphalting unit. The asphalt can comprise asphaltic material obtained from a solvent deasphalting unit, and spent adsorbent material in the asphalt composition that was previously utilized in the solvent deasphalting unit.

The asphalt composition can include spent adsorbent material selected from the group consisting of attapulgus clay, alumina, silica, activated carbon, silica alumina and zeolite catalyst material derived from one or more intermediate refining processes of hydrotreating, hydrocracking, or fluid catalytic cracking, and combinations comprising at least one of the foregoing adsorbent materials. Further, the spent absorbent material can include heavy polynuclear aromatic molecules, sulfur, nitrogen and/or metals.

As stated above, petroleum asphalt is the heavy residue of the oil refining process, or bottoms, from distillation units or other intermediate refining process units such including hydroprocessing, visbreaking, coking and solvent deasphalting. Asphalt from various sources is typically integrated into petroleum asphalt pools for collection and storage until asphalt product is ready to transport.

According to the present invention, a solvent deasphalting process encompassing the recycle of waste materials includes:

a. introducing a hydrocarbon oil feedstock containing asphaltenes, a paraffinic solvent and a solid adsorbent material into a mixing vessel;

b. separating a solid phase comprising asphaltenes and adsorbent material from the oil/solvent mixture;

c. passing at least a portion of the asphaltene/adsorbent mixture to a filtration vessel with a solvent to desorb the adsorbed compounds, and separating and recovering the solid asphalt phase in an asphalt pool;

d. recovering solid adsorbent material from the filtration vessel and passing said solid adsorbent material to the asphalt pool.

The solid adsorbent material is selected from the group consisting of attapulgus clay, alumina, silica activated carbon, zeolite catalyst materials and mixtures thereof.

In another embodiment, step (d) includes recovering spent solid adsorbent material having a pore volume of less than 50% of the original pore volume from the filtration vessel and passing said recovered solid adsorbent material to the asphalt pool.

In a further embodiment, a portion of the asphaltene/adsorbent mixture is passed to the asphalt pool directly after step (b).

According to another aspect of the present invention, a solvent deasphalting process encompassing the recycle of waste materials includes:

a. introducing a hydrocarbon oil feedstock containing asphaltenes into a mixing vessel with a paraffinic solvent and a solid adsorbent material selected from the group consisting of attapulgus clay, alumina, silica activated carbon, zeolite catalyst materials and combinations thereof;

b. mixing the solid asphaltenes formed in the paraffinic solvent phase with the adsorbent material for a time sufficient to adsorb sulfur- and nitrogen-containing polynuclear aromatic molecules on the adsorbent material;

c. separating the solid phase comprising asphaltenes and adsorbent material from the oil/solvent mixture;

d. passing the oil/solvent mixture to a separation vessel to separate the deasphalted oil and paraffinic solvent and recovering the solvent for recycling to the mixing vessel;

e. passing the asphalt/adsorbent material mixture to a filtration vessel with an aromatic or polar solvent to desorb the adsorbed compounds;

f. recovering and passing the solid asphalt phase to an asphalt pool; and g. recovering spent solid adsorbent material from the filtration vessel and passing said spent solid adsorbent material to the asphalt pool.

In another embodiment, step (g) includes recovering spent solid adsorbent material having a pore volume of less than 50% of the original pore volume from the filtration vessel and passing said recovered solid adsorbent material to the asphalt pool.

In a further embodiment, a portion of the asphalt/adsorbent material mixture is passed to the asphalt pool and the remainder of this mixture is passed to the filtration vessel.

In yet another embodiment, the process further comprises h. passing the mixture of desorbed compounds and aromatic or polar solvent to a fractionator to recover the solvent.

The present invention utilizes the waste solid adsorbent materials and liquid process reject stream containing heavy polynuclear aromatics from an enhanced solvent deasphalting unit by passing the solid-containing asphalt mixtures into the asphalt blending pool. If the asphalt-containing waste solid material is not sent to the asphalt pool, other disposal options must be found for the solid adsorbent materials.

The process waste, whether it is adsorption process liquid water or solid waste, can be utilized in asphalt blends. The present invention, therefore, solves the problem of disposing of wastes from solvent deasphalting processes utilizing adsorption and other processes using solid adsorbent materials in a petroleum refinery.

As used herein, "asphalt" means highly viscous liquid or semi-solid bitumen mixture that can be derived from natural deposits or petroleum refinery operations.

Additionally, as used herein, "spent adsorbent material" means used adsorbent material that has been determined to no longer have efficacy as adsorbent material for its intended application, and can include non-catalytic adsorbent materials and adsorbent materials that were originally used as catalytic materials, for instance, in hydrotreating, hydrocracking, and fluid catalytic cracking refinery processes.

In addition, as used herein, "process reject materials" means materials discharged from petroleum refinery operations as undesirable constituents including heavy hydrocarbon molecules containing sulfur, nitrogen and/or heavy aromatic molecules, heavy polynuclear aromatic molecules, and metals such as nickel and vanadium.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
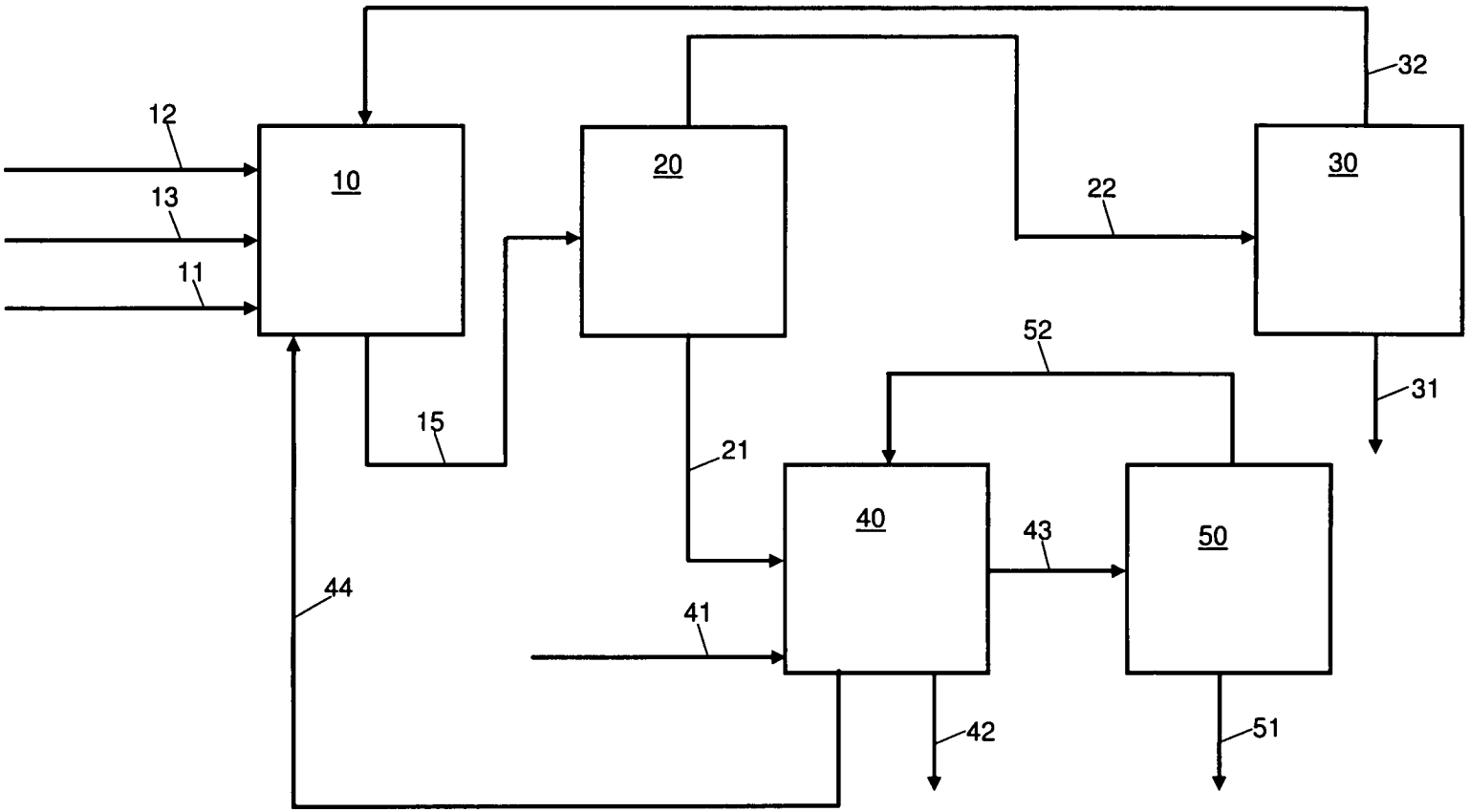
FIG. 1 is a schematic diagram of an enhanced solvent deasphalting apparatus.

An asphalt composition according to the present invention generally includes petroleum asphalt as the heavy residue of the oil refining process, or bottoms, from distillation units or other intermediate refining process units such as hydroprocessing, visbreaking, coking, solvent deasphalting, and the like, and spent adsorbent material from one or more refinery units in solid phase. In general, the asphalt composition includes solids in a range of about 0.5-25 weight %. In certain embodiments, the asphalt composition includes solids in a range of about 5-10 weight %. Depending upon the density of the spent adsorbent materials, the weight percentage ranges generally result in volumetric ratios of about 1-50 volume % of the total asphalt composition.

In one embodiment, the asphalt composition can include petroleum asphalt derived from a solvent deasphalting process, where a solute material including asphaltenes is separated from a hydrocarbon oil feedstock containing asphaltenes with a paraffinic solvent. Paraffinic solvents used in solvent deasphalting generally having from 3 to 8 carbons, as is conventionally known.

In another embodiment, the asphalt composition can include petroleum asphalt derived from a solvent deasphalting process, where a solute material including asphaltenes is be separated from a hydrocarbon oil feedstock containing asphaltenes with a paraffinic solvent and an adsorbent, for instance, as described in U.S. application Ser. No. 11/584,771.

In a further embodiment, the asphalt composition can include petroleum asphalt separated from a hydrocarbon oil feedstock containing asphaltenes by a two-stage solvent process. The two-stage process includes a first stage of contacting the feedstock with an adsorbent material and a paraffinic solvent, and recovering the paraffinic solvent. The second stage includes passing the combined feedstock and adsorbent to a filtration vessel with an aromatic or polar solvent to recovering the asphalt. The asphalt is passed to the asphalt pool for incorporation in the asphalt composition.

In the asphalt compositions described above, the adsorbent can be selected from the group consisting of attapulgus clay, alumina, silica, activated carbon, silica alumina and zeolite catalyst material derived from one or more intermediate refining processes of hydrotreating, hydrocracking, or fluid catalytic cracking, and combinations comprising at least one of the foregoing adsorbent materials. Further, the spent absorbent material can include adsorbed heavy polynuclear aromatic molecules, sulfur, nitrogen and/or metals. The adsorbent material can be in the form of pellets, spheres, extrudates and/or or natural shapes. The adsorbent material can be dimensioned in the range of about 4 to about 60 mesh, have a surface area in the range about 10 to about 500 $m^2/g$. Furthermore, the adsorbent material can have average pore sizes in the range of about 10 to about 5000 angstroms (about 0.001 to about 0.5 microns), and a pore volume in the range of about 0.1 to about 0.5 cc/g. In certain embodiments, clay adsorbent materials have pore sizes of about 10 to about 750 angstroms, and activated carbon adsorbent materials have pore sizes of about 5 to about 400 angstroms.

To provide ideal efficiency of use of the adsorbent material, while minimizing inefficient energy consumption, adsorbent material can be utilized until about 50% of its original pore volume becomes blocked by deposited carbonaceous and other material.

In further embodiments, an asphalt composition can include materials desorbed from the surface and/or pores of adsorbent material. Desorption of adsorbent material can be effectuated by washing with an aromatic solvent such as toluene, benzene or xylene, alcohols such as ethanol or methanol, alkyl ketones such as methyl ethyl ketone, furans such as tetrahydrofuran, or mixtures comprising at least one of the foregoing solvents. In certain preferred embodiments, solvents can be selected based on their Hildebrand solubility factors or on the basis of two-dimensional solubility factors. The overall Hildebrand solubility parameter is a well-known measure of polarity and has been tabulated for numerous compounds. (See, for example, Journal of Paint Technology, Vol. 39, No. 505, February 1967). The solvents can also be described by two-dimensional solubility parameters, i.e., the complexing solubility parameter and the field force solubility parameter. (See, for example, I. A. Wiehe, Ind. & Eng. Res., 34 (1995), 661). The complexing solubility parameter component which describes the hydrogen bonding and electron donor-acceptor interactions measures the interaction energy that requires a specific orientation between an atom of one molecule and a second atom of a different molecule. The field force solubility parameter which describes van der Waal's and dipole interactions measures the interaction energy of the liquid that is not effected by changes in the orientation of the molecules. In accordance with this invention, the polar solvent, or solvents, if more than one is employed, preferably has an overall solubility parameter greater than about 8.5 or a complexing solubility parameter of greater than one and a field force parameter value greater than 8. Examples of polar solvents meeting the desired solubility parameter are toluene (8.91), benzene (9.15), xylene (8.85), and tetrahydrofuran (9.52). Preferred polar solvents for use in the practice of the invention are toluene and tetrahydrofuran.

Materials desorbed from surface and/or pores of adsorbent material are generally process reject materials discharged from petroleum refinery operations as undesirable constituents including heavy hydrocarbon molecules containing sulfur, nitrogen and/or heavy aromatic molecules, heavy polynuclear aromatic molecules, and metals such as nickel and vanadium.

The asphalt composition according to the present invention has particular application to certain solvent deasphalting processes incorporating adsorbent material, such as described in U.S. application Ser. No. 11/584,771. In this enhanced solvent deasphalting process, heavy polynuclear aromatic hydrocarbons are selectively separated process using solid adsorbent materials in a solvent deasphalting unit. The solid adsorbent materials are regenerated and reused in the process. These adsorbent materials have limited life spans and must be disposed of after they have lost their efficacy for the intended purpose of adsorbing heavy hydrocarbon molecules containing sulfur, nitrogen and/or heavy aromatic molecules, heavy polynuclear aromatic molecules, and metals such as nickel and vanadium. The solid adsorbent materials used in the process of U.S. application Ser. No. 11/584,771 can include attapulgus clay, alumina, silica, activated carbon, spent catalyst, or combinations including at least one of the aforementioned solid adsorbent materials. The spent catalysts can be derived from an intermediate refining processes such as hydrotreating, hydrocracking, fluid catalytic cracking that, and are typically alumina, silica alumina or zeolite based catalysts. The asphalt or process residue extracted from the solid adsorbent materials from the solvent deasphalting unit can be used directly as an asphalt component, or blended in an asphalt pool that includes asphalt from other sources.

As an example, the solvent deasphalting unit of U.S. application Ser. No. 11/584,771 is described in FIG. 1 for convenience. In general, an enhanced solvent deasphalting unit 8 includes a mixing vessel 10, a first separation vessel 20, a second separation vessel 30, a filtration vessel 40 and a fractionator 50. A heavy hydrocarbon feedstock 11 is introduced into the mixing vessel 10 with a paraffinic solvent stream 12 and a solid adsorbent material 13, e.g., in the form of a slurry. The paraffinic solvent typically has the general formula $C_nH_{2n+2}$, where n=3 to 7. The mixing vessel 10 is maintained at an elevated temperature and pressure, generally below the critical temperature and pressure of the selected solvent. The mixing vessel 10 is equipped with a suitable mixing apparatus such as rotary stirring blades or paddles that provide gentle yet thorough mixing of the contents, for a period that can range from about 30 to 150 minutes, depending on the mixture components. The rate of agitation in the mixing vessel 10 is selected to minimize or prevent attrition of particles or granules of adsorbent material.

The effluent from the mixing vessel 10, a solvent-adsorbent-heavy oil mixture 15, is passed to the first separation vessel 20 at a temperature and pressure below the solvent's critical values and that is suitable to separate the mixture 15 into a top stream 22, comprising light and less polar fractions, and a bottom stream 21, comprising asphaltenes and solid adsorbent material. For instance, separation vessel 20 can be a vertical flash drum.

The top fraction 22 is introduced into the second separation vessel 30 maintained between the boiling and critical temperature of the solvent while maintaining a pressure of about one to three bars to separate solvent from the deasphalted oil. The solvent stream 32 is recovered and recycled back to the mixing vessel 10, preferably in a continuous operation. The deasphalted oil 31 is discharged from the bottom of the second vessel 30. The deasphalted oil 31 generally contains reduced levels of contaminates, i.e., it contains no metals, and about 80 weight % of nitrogen and 20-50 weight % of sulfur that were present in the original feed 11 have been removed.

The bottoms from the first separation vessel 20 include an asphalt and adsorbent material stream 21, which are washed with an aromatic and/or polar solvent stream 41 in the filtration vessel 40. The solvent stream 41 can comprise benzene, toluene, xylenes, or tetrahydrofuran. In the filtration vessel 40, the adsorbent materials are separated and cleaned. The clean solid adsorbent material stream 44 is recovered and recycled back to the mixing vessel 10. The asphalt material 42 extracted from the solid adsorbent materials can be used directly as an asphalt component, or blended in an asphalt pool that includes asphalt from other sources.

The solvent-asphalt mixture 43 from the filtration vessel 40 is passed to the fractionator 50 to separate the solvent from the material containing the heavy polynuclear aromatic compounds, which are withdrawn as stream 51. The clean solvent is recovered as stream 52 and recycled back to the filtration vessel 40.

Figure 2:
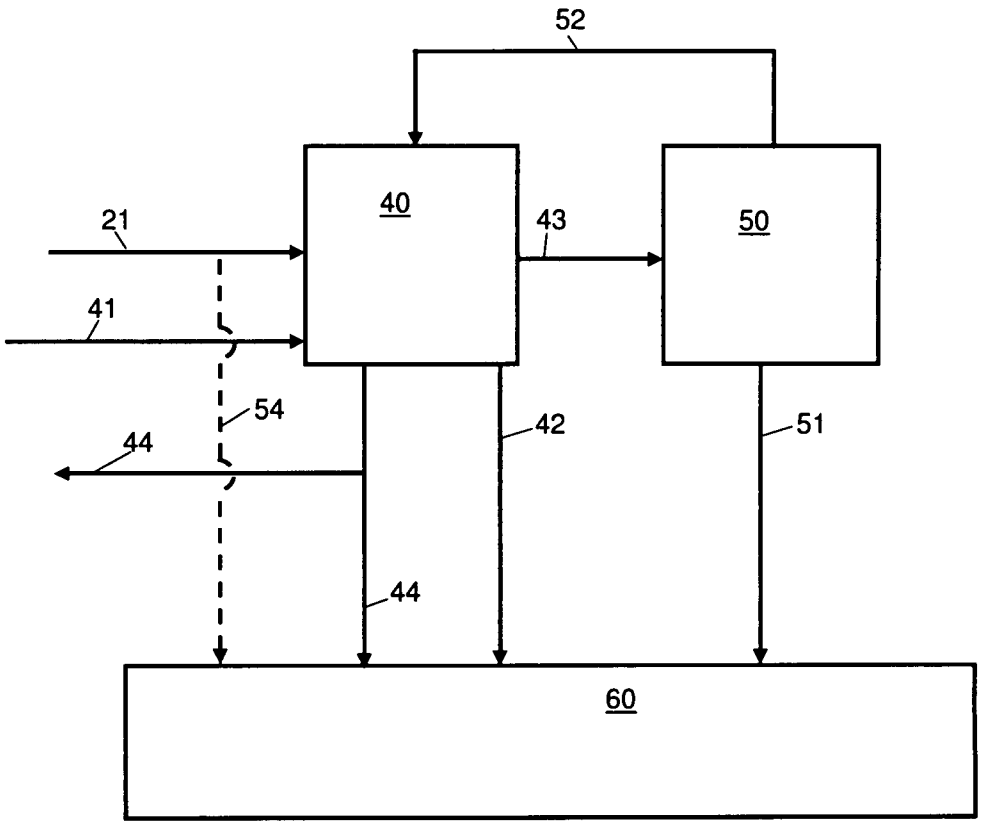
FIG. 2 is a schematic diagram of portions of the enhanced solvent deasphalting apparatus of FIG. 1 illustrating an asphalt pool integrating asphalt, adsorbent material and process reject materials.

According to the present invention, and referring now to FIG. 2, the filtration vessel 40 and the fractionator 50 discharge materials into an asphalt pool 60. In particular, a waste adsorbent material stream 44 and asphalt 42 recovered from the filtration vessel 40 are sent to the asphalt pool 60, for instance, to be used as paving materials or cutback asphalt. In addition, the process reject materials, which include bituminous materials, are discharged as stream 51 from the fractionator 50 and are blended in the asphalt pool 60. A portion 54 of the asphalt and adsorbent material mixture stream 21 can also be discharged directly into the asphalt pool 60, for example, if the adsorbent materials are not to be recycled back to the mixing vessel 10 of the enhanced solvent deasphalting unit 8.

As described herein, the solvent deasphalting bottoms portion from the solvent deasphalting process containing about 1-25 weight % solid adsorbent materials, based on the combined weight of asphalt 42 discharged from the unit and adsorbent waste 44, are integrated into the asphalt pool 60.

The asphalt can be derived from hydrocarbons such as crude oils, bitumens, heavy oils, shale oils, refinery streams including atmospheric and vacuum residues, fluid catalytic cracking slurry oils, coker bottoms, visbreaking bottoms, or coal liquefaction products. Any heavy oil containing asphalts can be used as the source of asphalt.

The method and apparatus of the present invention have been described above and in the attached drawings; however, modifications will be apparent to those of ordinary skill in the art and the scope of protection for the invention is to be determined by the claims that follow.

The invention claimed is:

1. A solvent deasphalting process comprising:

a. introducing a residual oil feedstock containing asphaltenes, a paraffinic solvent and a solid porous adsorbent material into a mixing vessel and maintaining the components in the mixing vessel for a time sufficient so that carbonaceous materials and contaminant compounds including sulfur- and nitrogen-containing polynuclear aromatic molecules are adsorbed on the adsorbent material and within the pores of the adsorbent material;

b. separating a solid phase comprising asphaltenes and adsorbent material from the oil/solvent mixture;

c. passing at least a portion of the asphaltene/adsorbent mixture to a filtration vessel with a solvent to desorb at least a portion of the adsorbed compounds, and separating and passing the solid asphalt phase to an asphalt pool;

d. recovering solid adsorbent material having carbonaceous materials and contaminant compounds including sulfur- and nitrogen-containing polynuclear aromatic molecules deposited within its pores from the filtration vessel and passing said solid adsorbent material to the asphalt pool, wherein no more than about 50% of the original pore volume of the adsorbent material is blocked by carbonaceous materials and contaminant compounds;

e. recovering the solvent stream, which includes process reject materials comprising bituminous materials and heavy polynuclear aromatic compounds, from the filtration vessel and passing said solvent stream to a fractionator to separate the process reject materials from the solvent; and f. recovering said process reject materials from the fractionator and passing the process reject materials to the asphalt pool.

2. The process of claim 1, wherein the solid adsorbent material is selected from the group consisting of attapulgus clay, alumina, silica, activated carbon, zeolite catalyst materials and combinations thereof.

3. The process of claim 1, wherein a portion of the asphaltene/adsorbent mixture is passed to the asphalt pool directly after step (b).

4. A solvent deasphalting process comprising:

a. introducing a residual feedstock containing asphaltenes into a mixing vessel with a paraffinic solvent and a solid adsorbent material selected from the group consisting of attapulgus clay, alumina, silica, activated carbon, zeolite catalyst materials and combinations thereof;

b. mixing the solid asphaltenes formed in the paraffinic solvent phase with the adsorbent material for a time sufficient to adsorb sulfur- and nitrogen-containing polynuclear aromatic molecules on the adsorbent material;

c. separating the solid phase comprising asphaltenes and adsorbent material as an asphalt/adsorbent material mixture from a remaining oil/solvent mixture;

d. passing the oil/solvent mixture to a separation vessel to separate the deasphalted oil and paraffinic solvent and recovering the solvent for recycling to the mixing vessel;

e. passing the asphalt/adsorbent material mixture to a filtration vessel with an aromatic or polar solvent to desorb at least a portion of the adsorbed compounds;

f. recovering and passing a solid asphalt phase to an asphalt pool;

g. recovering spent solid adsorbent material having carbonaceous materials and contaminant compounds including sulfur- and nitrogen-containing polynuclear aromatic molecules deposited within its pores from the filtration vessel and passing said spent solid adsorbent material to the asphalt pool, wherein no more than about 50% of the original pore volume of the adsorbent material is blocked by carbonaceous materials and contaminant compounds;

h. recovering the solvent stream, which includes process reject materials comprising bituminous materials and heavy polynuclear aromatic compounds, from the filtration vessel and passing said solvent stream to a fractionator to separate the process reject materials from the solvent; and i. recovering said process reject materials from the fractionator and passing the process reject materials to the asphalt pool.

5. The process of claim 4, wherein a portion of the asphalt/adsorbent material mixture is passed to the asphalt pool and passing the remainder of this mixture to the filtration vessel.

* * * * *